US006200019B1

(12) United States Patent
Latini

(10) Patent No.: US 6,200,019 B1
(45) Date of Patent: Mar. 13, 2001

(54) DEVICE FOR LOCKING THE ROTATABLE BEZEL OF WATCHES, ESPECIALLY UNDERWATER WATCHES, AND FOR RENDERING THE WINDING BUTTON WATERTIGHT

(75) Inventor: Bruno Latini, Greve in Chianti (IT)

(73) Assignee: Cartier International B.V., Amsterdam (NL)

( * ) Notice: Subject to any disclaimer, the term of this patent is extended or adjusted under 35 U.S.C. 154(b) by 0 days.

(21) Appl. No.: 09/194,759

(22) PCT Filed: Jun. 2, 1997

(86) PCT No.: PCT/EP97/02852

§ 371 Date: Dec. 2, 1998

§ 102(e) Date: Dec. 2, 1998

(87) PCT Pub. No.: WO97/46921

PCT Pub. Date: Dec. 11, 1997

(30) Foreign Application Priority Data

Jun. 3, 1996 (IT) ..... RM96A0387

(51) Int. Cl.[7] ..... G04B 37/02

(52) U.S. Cl. ..... 368/289; 368/288; 368/291; 368/295

(58) Field of Search ..... 368/288, 289, 368/290, 294, 295, 319, 320, 321, 215, 194, 291

(56) References Cited

U.S. PATENT DOCUMENTS 4,346,464 * 8/1982 Wenger ..... 368/289
5,237,546 * 8/1993 Vollert ..... 368/294
5,257,247 * 10/1993 Miche et al. ..... 368/319
5,319,617 * 6/1994 Sonoda ..... 368/295
5,383,166 * 1/1995 Gallay ..... 368/288
5,521,889 * 5/1996 Scarinzi et al. ..... 368/294
5,521,890 * 5/1996 Miche et al. ..... 368/319
5,742,565 * 4/1998 Cuinet et al. ..... 368/319

FOREIGN PATENT DOCUMENTS 673 197 2/1990 (CH) .
1 166 504 11/1958 (FR) .
364 878 1/1932 (GB) .

* cited by examiner

*Primary Examiner*—Diego Gutierrez
*Assistant Examiner*—Jeanne-Marguerite Goodwin
(74) *Attorney, Agent, or Firm*—Woodcock Washburn Kurtz Mackiewicz & Norris LLP

(57) ABSTRACT

A device for locking the rotatable bezel of a watch and for rendering the winding button thereof watertight comprises a plastic washer connected to a flat surface of said button, coaxially thereto, so as to engage with circumferential knurling of the rotatable bezel, when the button is in a returned position, adjacent to the casing of the watch, in order to ensure the locking of the bezel. The device further comprises a seal which is carried by the button so as to be compressed between it and the casing when the button is in said returned position, in order to ensure watertightness of the button. Pressure means, movably supported by the casing, in a first position axially press the button holding it in said returned position and, in a second position, permits the outwards movement of the button to a rewinding and resetting position.

5 Claims, 6 Drawing Sheets

DEVICE FOR LOCKING THE ROTATABLE BEZEL OF WATCHES, ESPECIALLY UNDERWATER WATCHES, AND FOR RENDERING THE WINDING BUTTON WATERTIGHT

FIELD OF THE INVENTION

The present invention relates generally to sports or work watches for underwater use which are provided with a bezel in the form of a circular annulus and carrying reference or measurement data and information.

More especially, the invention relates to a device which is suitable, first of all, for permitting watertightness of the rewinding and resetting button of such watches and, secondly, for ensuring at the same time that the rotatable bezel thereof is locked.

BACKGROUND OF THE INVENTION

It is known that it is difficult to achieve watertightness in the casing of instruments, especially watches, that have to be able to work in a fluid environment of which the penetration into the casing would damage the mechanisms contained therein.

Various solutions are also known which aim to provide sealed closure of the casing and which involve a seal acting on the shaft of the winding button which has to be rendered watertight or acting on a part which is rigid with or in one piece with the shaft or which in any case constitutes a part thereof functionally.

In some types of watch, for example, watches for underwater immersion or watches having a double time zone and the like, it is also known that there is a problem involved in locking the rotatable bezel carrying particular operational information, for example, the decompression times for underwater watches. This locking prevents a situation where, after the setting of the bezel in accordance with requirements, the bezel may change its position accidentally, thus rendering its setting void and creating a potentially dangerous situation for the diver who no longer has the required information and, what may be worse, is unaware of the unreliability and incorrectness of the information with which the bezel nevertheless provides him.

In the majority of commercial watches, this positive locking does not exist and the resistance which the bezel has to rotation owing to the friction of the resilient members which maintain the bezel in position is normally relied upon to prevent undesired rotation of the bezel.

Only in some watches, which are of particularly high quality and which are therefore expensive, is the locking in question obtained by means of a special structure of the bezel, which has to be pushed downwards to disengage it from its support and to permit rotation thereof.

CH 673 197 A discloses a device for application to watched having various features disclosed in this specification.

FR 1 166 504 A discloses a device for ensuring watertightness of underwater watches though the action of pressure means capable of maintaining a button pressed on a seal.

GB 364 878 A discloses a watch with a button connected integrally to a sleeve element forming an annular groove wherein a seal is carried.

BRIEF SUMMARY OF THE INVENTION

With regard to the watertightness of the winding button, it is provided in accordance with the present invention to apply a seal directly to the casing of the instrument and to cause it to act not on the shaft of the winding button but directly on the winding button itself, thus leaving the shaft free. In a preferred embodiment, it is then provided to apply to the casing of the watch the means by which it is possible to move the winding button from a disengaged position into a position in which it presses on the seal, by deliberate action from outside, the means being such as to leave the button free to be rotated for winding or resetting or to be moved axially into the returned position, as desired.

As regards the locking of the bezel, the present invention achieves the desired effect by making use of the winding button. It is provided that the winding button carry a plastics washer which faces the circumferential knurling of the bezel and which, when the button is in the returned position, interferes with the bezel and locks it.

A specific subject of the present invention, therefore, for application to watches provided with a rotatable bezel having knurling on the external circumference and a rewinding and resetting button, is a device for ensuring the locking of the rotatable bezel and the watertightness of the winding and resetting button, characterised in that it comprises, in combination, a plastics washer, which is applied to the flat surface of the button in a position facing the knurling of the rotatable bezel and which is capable of interfering with the same, a seal which is carried by the winding and resetting button and which can be brought into engagement with the casing of the watch in order to ensure watertightness in the area of the winding and resetting button, and also pressure means which are capable of maintaining the button pressed on the seal and of maintaining the plastics washer in engagement with the external knurling of the rotatable bezel.

In the preferred embodiment, the means for pressing and engagement are formed by a frame mounted on the watch casing and carrying a cam lever which is pivoted on a pin and which is capable, in a first position, of holding the button against the casing in order to compress the seal between the button and the casing and to maintain the plastics washer engaged in the external knurling of the rotatable bezel and, in a second position, of releasing the button.

BRIEF DESCRIPTION OF THE DRAWINGS

Other details and advantages of the present invention will become clear from the following description which is given with reference to the appended drawings in which the preferred embodiment is represented purely by way of non-limiting example.

DETAILED DESCRIPTION OF THE INVENTION

Figure 1:
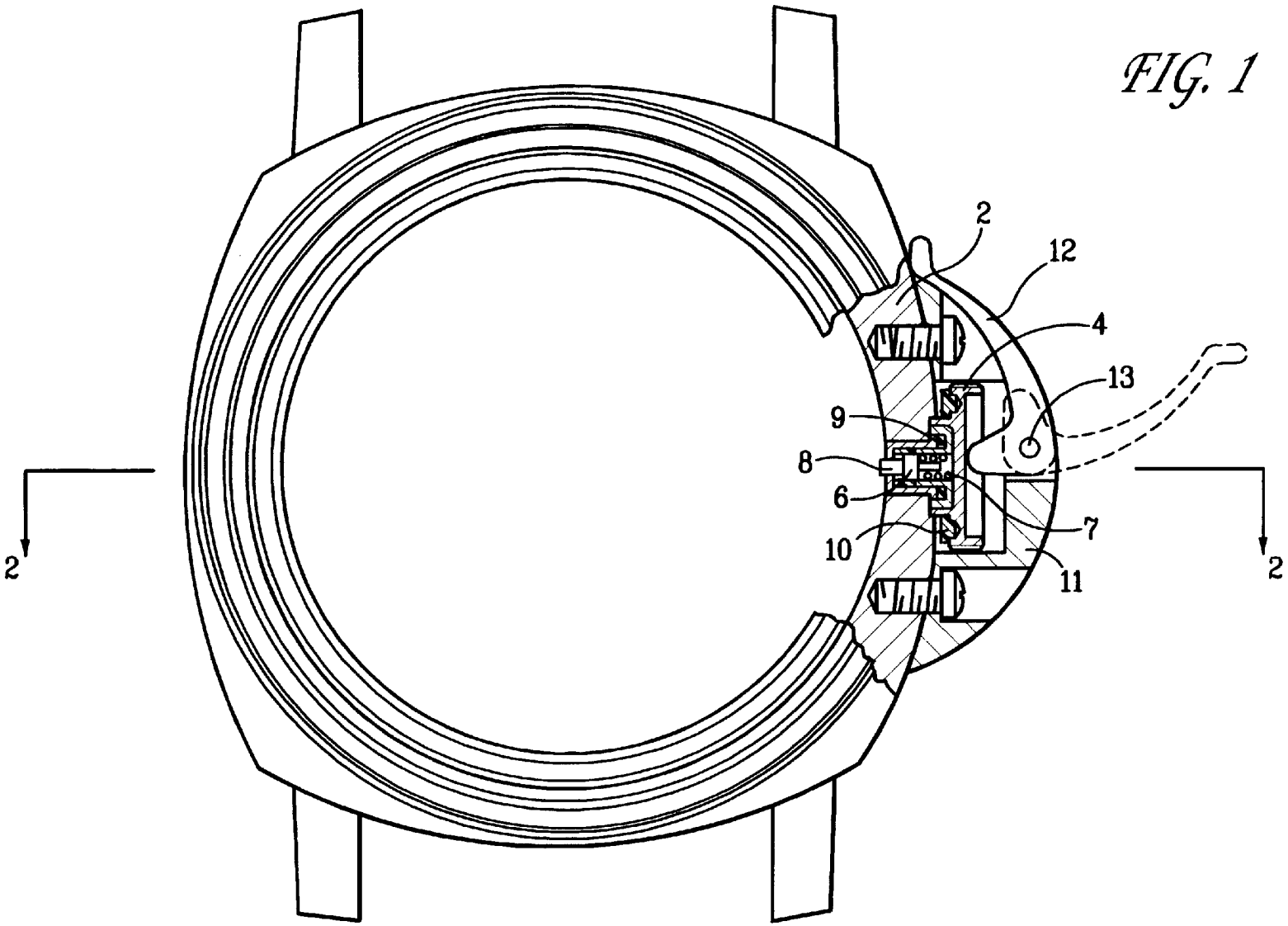
FIG. 1 is a partially sectioned top view showing the mechanism for locking the bezel and the mechanism for rendering the winding button watertight.
Figure 2:
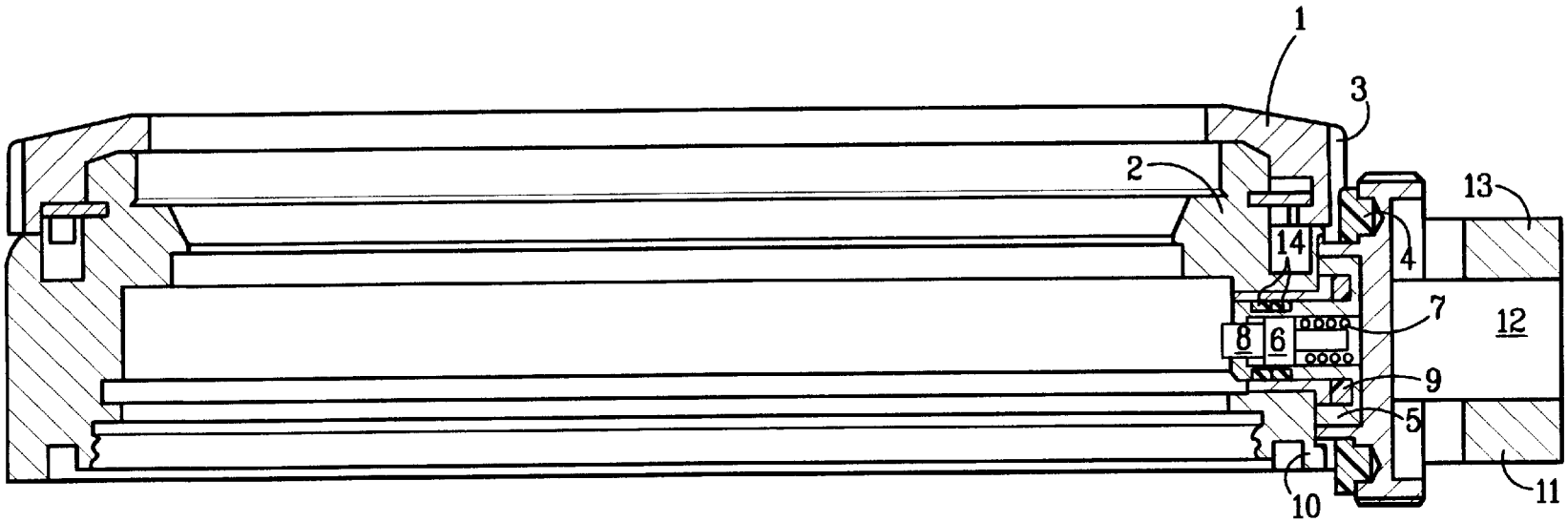
FIG. 2 is a sectional view of the entire watch, taken along the section line A—A of FIG. 1.
Figure 3:
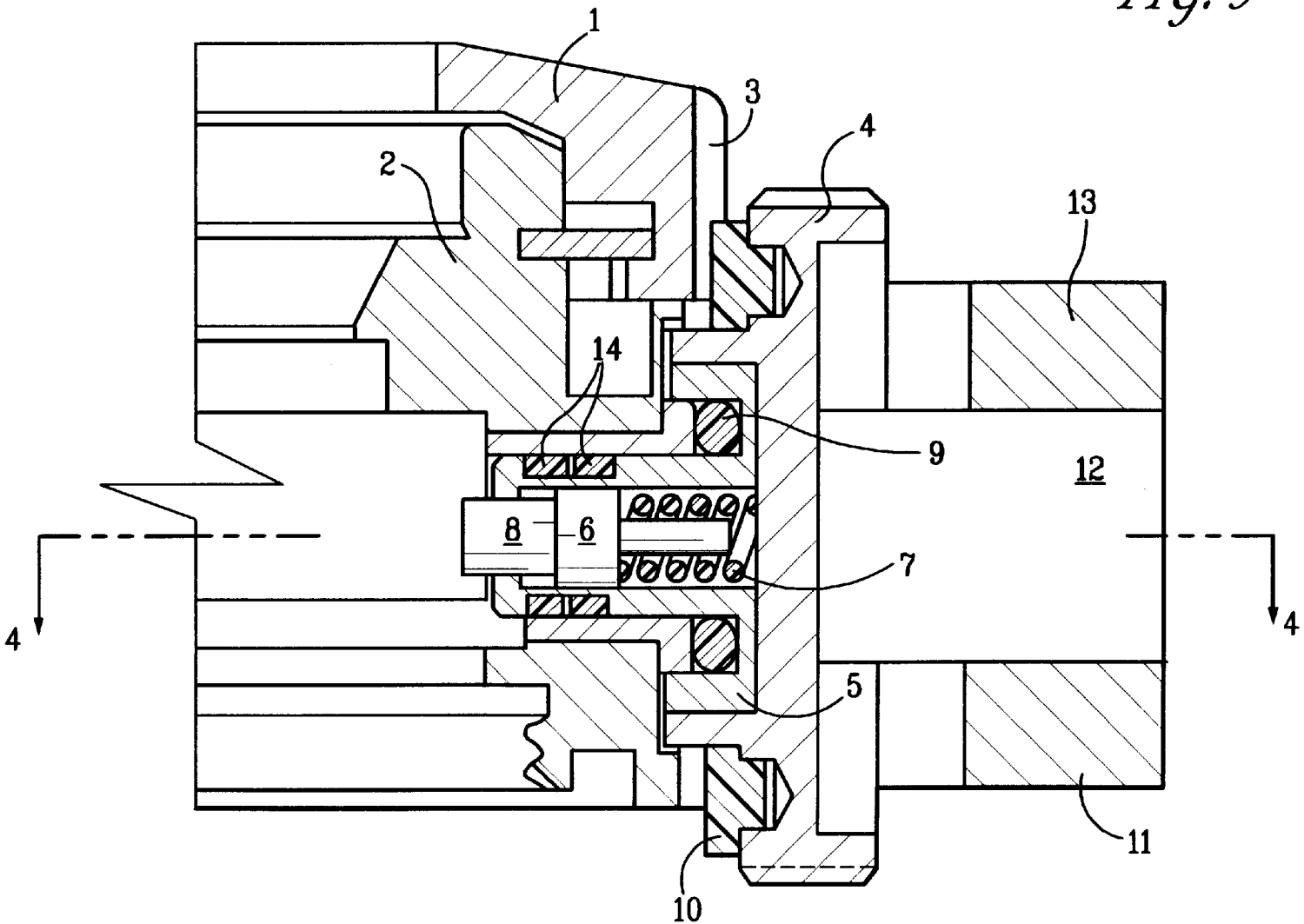
FIG. 3 is a sectioned and enlarged vertical section, from the side, through the mechanism for locking the bezel and for rendering the button watertight in accordance with the present invention.
Figure 4:
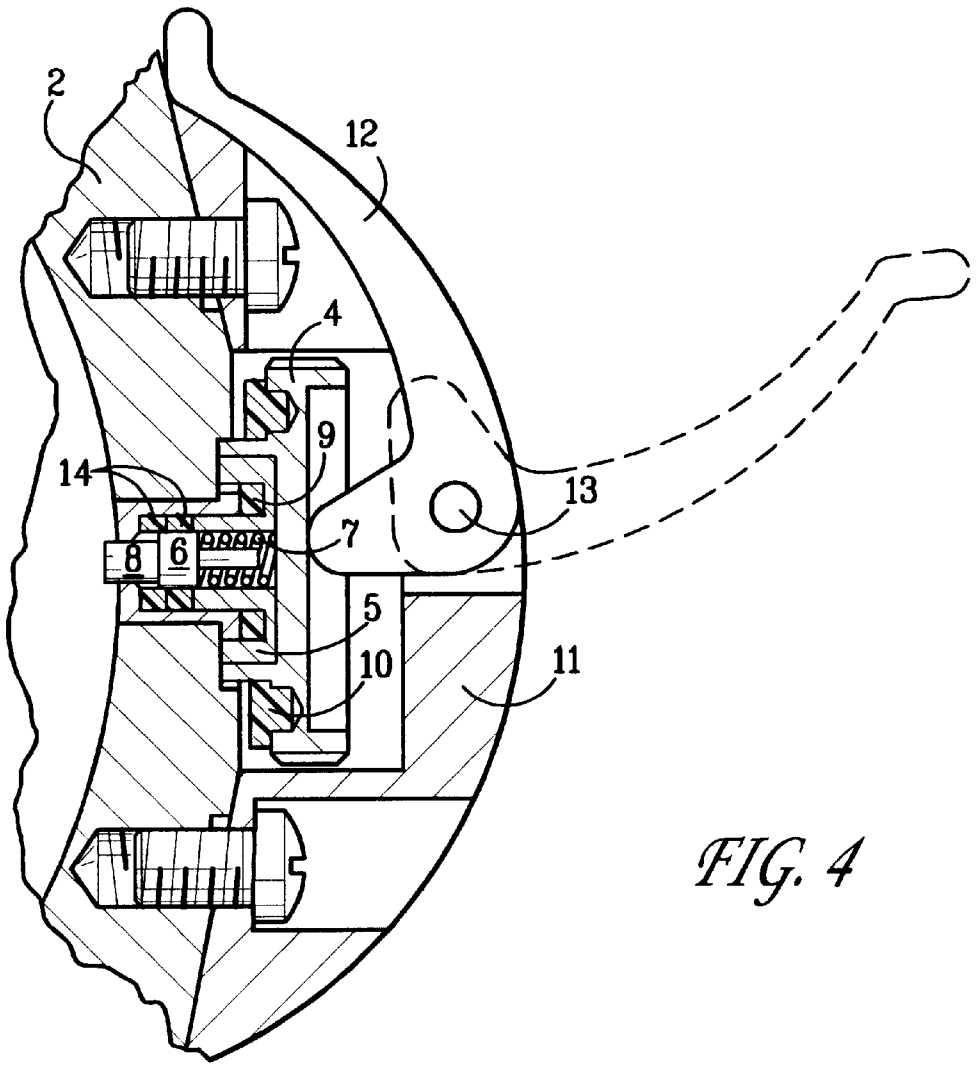
FIG. 4 is an enlarged top view sectioned along the line AA—AA of FIG. 3 of the mechanism for locking the bezel and for rendering the button watertight in accordance with the present invention.
Figure 5:
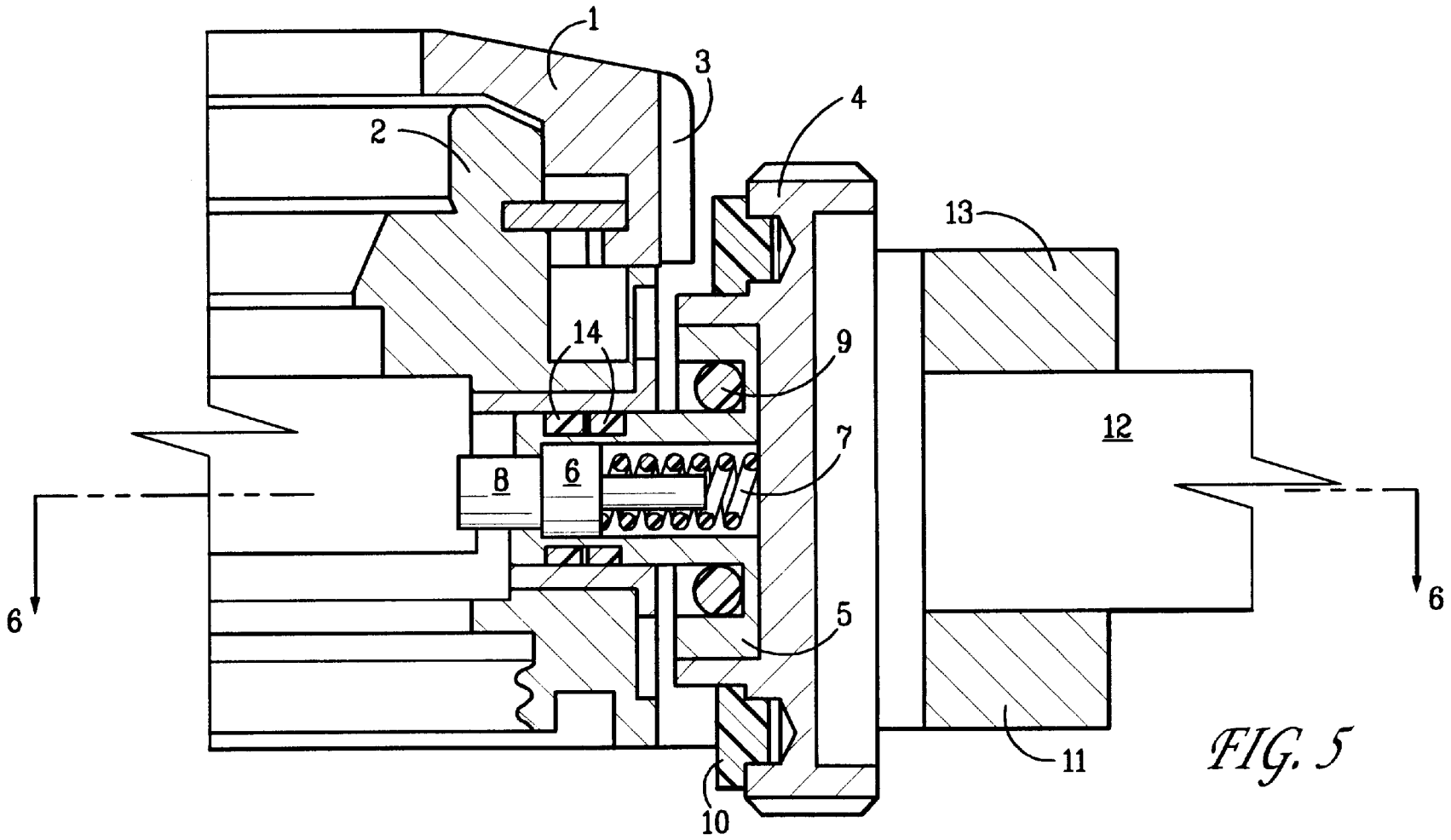
FIG. 5 is a sectioned and enlarged vertical section, from the side, through the mechanism for locking the bezel and for rendering the button watertight in accordance with the present invention, with a cam lever in an up or second position.
Figure 6:
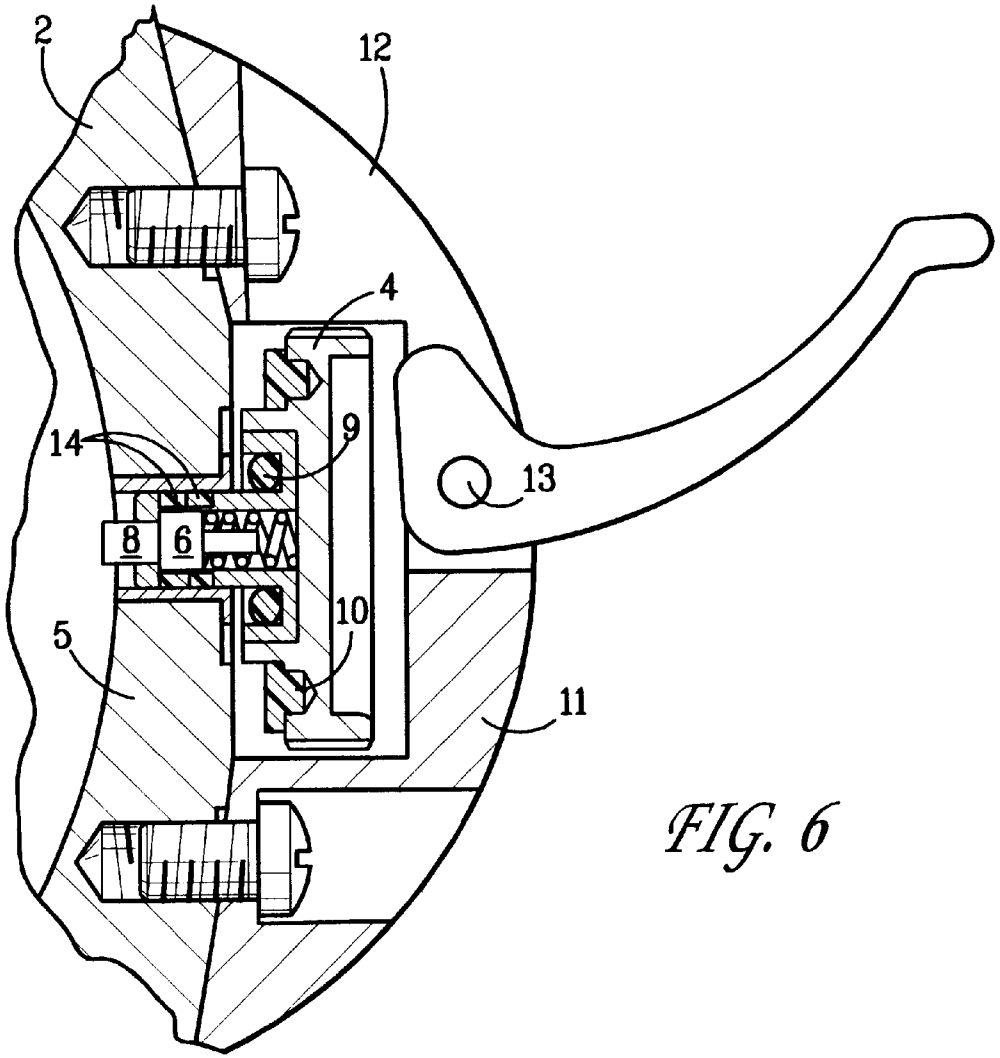
FIG. 6 is an enlarged top view sectioned along the line AAA—AAA of FIG. 5 of the mechanism for locking the bezel and for rendering the button watertight in accordance with the present invention, with a cam lever in an up or second position.

Referring now to a Figures and especially to FIGS. 3 and 4, the rotatable watch bezel mounted on a casing 2 and having a circumferential knurling 3 has been indicated with the reference numeral 1.

A winding button 4 is integral with a sleeve 5 inside which slides a pin 6 which carries a spring 7 and in which a threaded hole 8 is formed in which the movement winding shaft is screwed. A seal 9 is housed in an annular seat of sleeve 5.

A plastics washer 10 is provided on button 4, in a position facing knurling 3 of bezel 1.

A frame 11 carrying a cam lever 12 which rotates on a shaft 13 and acts on a button 4 is mounted on casing 2.

When lever 12 is rotated into the position shown by the continuous line in the Figures, the cam element of the lever presses on button 4, pushing it towards casing 2, and therefore the button 4, by means of sleeve 5 integral therewith, presses seal 9 and maintains it pressed against the watch casing, thus ensuring watertightness in the area of the passage of the watch winding shaft.

FIGS. 3 and 4 also show that, when lever 12 is in the engaged position, plastics washer 10 is engaged with the teeth of knurling 3 of the bezel and prevents the rotation thereof.

In order to unlock both bezel 1, in order to adjust a different setting, and button 4, in order to wind watch or to reset it, it is necessary only to rotate the lever 12 about its shaft 13, bringing it into the position shown by the broken line in FIG. 4. In that position, the cam part of lever 12 becomes disengaged from button 4, thus removing the engagement pressure between the button and seal 9. The button can thus be moved outwards, releasing bezel 1 and seal 9 and, being free, can be manipulated as in any other watch.

Pin 6 on which the movement shaft is mounted, sliding axially inside sleeve 5 integral with button 4, makes it possible, in conjunction with spring 7, to recover the working tolerances. In particular, spring 7 prevents any free axial movement of button 4 in the reset position.

In the enlarged view of FIG. 3, it is also possible to see two annular seals 14 which ensure, although to a lesser extent, the watertightness of button 4 in the disengaged position also.

A description has been given above of the preferred embodiment of the present invention, but it should be appreciated that experts in the art can introduce other variants, modifications and changes to the details and structural features without thereby departing from the scope of the present industrial invention.

What is claimed is:

1. A device for application to a watch having a casing, a bezel rotatably coupled to the casing, a movement located inside the casing, a rewinding and resetting button located external to the casing, and a winding shaft coupled to the movement and the rewinding and resetting button and extending through a passage in the casing, the device comprising:

a plastic washer contacting a flat surface of the rewinding and resetting button and being coaxially disposed with the rewinding and resetting button, the plastic washer engaging knurling along an outer circumference of the bezel when the rewinding and resetting button is in a retracted position adjacent the casing so that the bezel is locked in place;

a seal carried by the rewinding and resetting button so that the seal is compressed between the rewinding and resetting button and the casing when the rewinding and resetting button is in the retracted position thereby rendering the passage within the casing water-tight; and a pressure means coupled to the casing and movable between a first and a second position, the pressure means axially pressing the rewinding and resetting button when the pressure means is located in the first position so that the rewinding and resetting button is held in the retracted position, the pressure means permitting an outwards movement of the rewinding and resetting button to a rewinding and resetting position when the pressure means is located in the second position.

2. A device according to claim 1, wherein the seal is carried in an annular groove formed in a sleeve element connected integrally to the rewinding and resetting button.

3. A device according to claim 2, wherein the sleeve element incorporates a spring means and permits recovery of working tolerances in a connection between the rewinding and resetting button and a movement shaft rotatably disposed within the casing.

4. A device according to claim 2, further comprising at least one other seal located between the sleeve element and the casing for ensuring watertightness of the rewinding and resetting button.

5. A device according to claim 1, wherein the pressure means comprises a frame mounted on the casing and a cam lever pivotally coupled to the casing, the cam lever axially pressing the rewinding and resetting button when the pressure means is located in the first position.

* * * * *